United States Patent [19]

Alexandersson

[11] 4,280,417

[45] Jul. 28, 1981

[54] INCINERATION PLANT

[75] Inventor: Sven Alexandersson, Risskov, Denmark

[73] Assignee: Bruun & Sörensen AB, Sweden

[21] Appl. No.: 98,178

[22] Filed: Nov. 28, 1979

[51] Int. Cl.[3] ..... F23G 7/00

[52] U.S. Cl. ..... 110/346; 110/247; 110/248; 110/250; 110/256

[58] Field of Search ..... 110/242, 247, 248, 250, 110/256, 346, 235

[56] References Cited

U.S. PATENT DOCUMENTS

| | | | |
|---|---|---|---|
| 2,171,538 | 9/1939 | Black et al. | 110/247 X |
| 2,483,918 | 10/1949 | Martin | 110/247 X |
| 3,801,082 | 4/1974 | Anderson | 110/256 |
| 3,823,677 | 7/1974 | Polsak | 110/248 X |
| 4,205,614 | 6/1980 | Good | 110/346 |

*Primary Examiner*—Edward G. Favors
*Attorney, Agent, or Firm*—Holman & Stern

[57] ABSTRACT

A combustion process and a plant therefor, said process comprising the steps of introducing combustion material into a first chamber included in the plant and burning said combustion material therein, and finally burning out and treating in a second chamber residual products, such as gases and gas-borne components as well as slag, ash and the like passing into said second chamber from said first chamber.

The novelty of the process resides in that the combustion in the first chamber is controlled so that a pyrolitic process takes place therein and that combustible gases expelled during said process are led to the second chamber in which the gases are burnt while yielding high heat which is utilized for melting the slag, the air and the like, and in that air or oxygen is supplied to bring about decarbonization of the slag.

The novelty of the plant resides in that the first chamber is adapted to be continuously closed during operation—also during charging—and is provided with air supply means adapted to the intended process, and in that the second chamber is provided with means causing the slag and ash melt to move as means for supplying air or oxygen.

12 Claims, 1 Drawing Figure

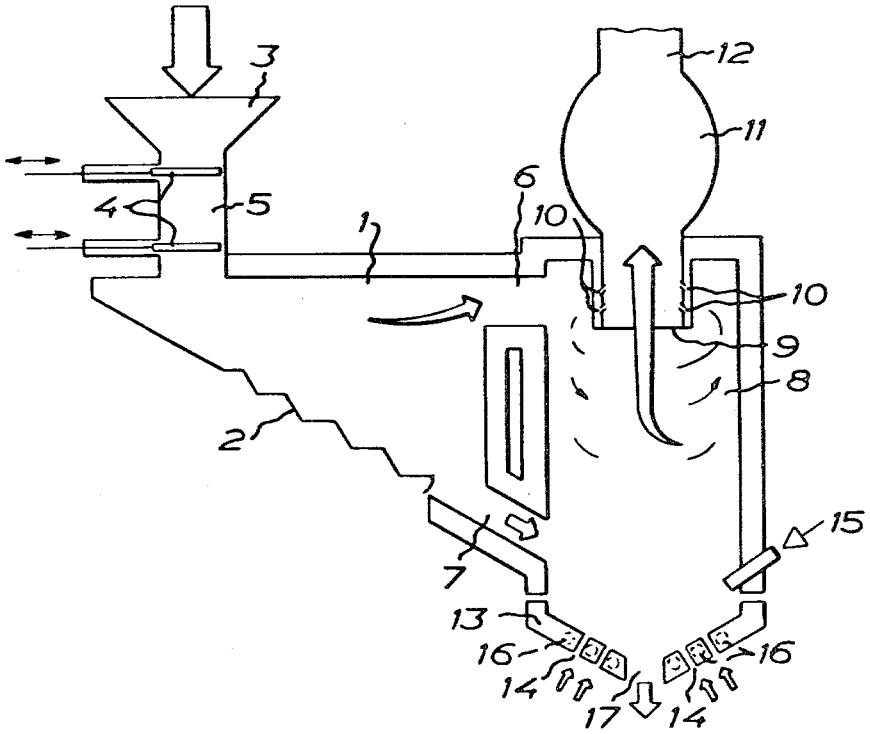
3
12
11
6
4
5
10
1
10
9
8
2
15
7
13
16
16
14
17
14

INCINERATION PLANT

This invention relates to a process for combustion of combustion material of heterogeneous nature, using a first chamber for burnout and degassing of the combustion material and a second chamber, communicating with the first chamber, for final combustion and melting of the residual products from the first chamber.

The present invention also relates to an incineration plant, including an incinerator or combustion furnace through which combustion material is allowed to pass during successive burnout and degassing and after said incinerator a secondary combustion chamber provided with means for supplying air and intended for the combustion of products having passed the incinerator without being completely burnt out, and in which combustion gases entering the secondary combustion chamber are subjected to a rotary motion facilitating separation of carried particles, and slag having entered said chamber is burnt out.

In incineration plants, especially for refuse and waste, but also for coal, peat and other fossil combustibles, the incineration in the incinerator or combustion furnace proper gives residual products of principally two kinds, viz. those which accompany the combustion gases and those which form ash or slag because they are heavy or difficultly fusible.

The composition of the combustion gases may be controlled to a certain degree by properly adjusting the supply of oxygen required for the combustion. Particles entrained by the gases may be further burnt off in a second combustion step and remaining fine particles may be separated off in filters of various types.

The other residual products, ash and slag, which are deposited after being allowed to cool, are regarded as waste that is difficult to handle because they may contain comparatively large amounts of unburnt combustible matter and also noxious substances which under certain conditions may be leached and may damage e.g. the ground and ground water.

In other fields it has been proposed to neutralize noxious and toxic substances by heating to a high temperature but such processes have been found too expensive considering the large volume in relation to the comparatively low percentage of such substances in the ash and slag.

The object of the invention is to provide a process and an incineration plant in which, in addition to obtaining a maximum utilization of heat, the combustion residues, the combustion gases and the particles entrained thereby as well as ash and slag, can be treated in a continuously operating process so that the final residual products will be minimized and neutralized.

The process is essentially characterized by the following steps:—continuously keeping the first chamber closed during operation and also during introduction of combustion material thereinto and supplying to said chamber a controlled amount of combustion air so adjusted that a pyrolitic process will take place therein during which gas is discharged from the combustion material which burns together; transferring incompletely burnt gases expelled from the combustion material, together with gas-borne particles and the like, from the first chamber to the second chamber, through a per se known first passage situated in the upper part and opening essentially tangentially into the second chamber, and transferring the burnt-together, partly melted-together remainder of the combustion material from the first to the second chamber, through a second passage situated in the lower part, while the gases which, under the influence of the position of the first passage produce a circulatory motion, in addition to burnout of carried particles and the like, during the combustion in the second chamber cause heating to melting temperature of the material present in the lower part of the chamber and, if required, supplying additional heat to said lower part in order to reach the temperature required for maintaining a melt; and, while the melt is being stirred in the lower part of the chamber, supplying air or oxygen to the melt in order to effect decarbonization of it.

The incineration plant is essentially characterized in that the incinerator or furnace, which is provided with a grate adapted to the type of combustion material or combustible concerned and with means for controlled supply of properly tempered combustion air, includes sluice means at the charge inlet to prevent pressure variations in the furnace as well as uncontrolled supply of air in order to allow pyrolitic, gas-expelling combustion in the furnace, and the secondary combustion chamber in which the gases from the furnace are burnt and at the lower part of which a passage for slag and unburnt residues of combustion material opens, is provided with means for stirring of such material and means securing appropriate slag melting temperature and also has means in said lower part for supplying air or oxygen for reducing the carbon in said slag melt.

This process and this construction permits obtaining not only efficient utilization of heat but also flue gases which, already when they leave the secondary combustion chamber, contain an extremely small amount of gas-borne or gasiform pollutants and thus readily allow of further utilization, and also residual products in solid state which, due to the high-temperature treatment and decarbonization, are entirely free from combustible or leachable noxious components and which therefore can be utilized as filling material or the like.

Embodiments of an incineration plant for use in connection with the process according to the invention will be more fully described hereinbelow with reference to the accompanying drawing, which shows a schematic cross-section of such an incineration plant.

The incinerator or combustion furnace, generally designated 1, included in the incineration plant should be adapted to the type of combustion material to be principally treated therein. If the combustion material mainly consists of refuse having a large volume as compared to the weight of combustible components, use is generally made of a grate 2 of the type shown, causing deflection and agitation of the material during combustion.

If, however, the combustion material contains a large amount of combustible matter per volume unit, e.g. coal, use is preferably made of a grate in which the combustion material is fed by means of a vibrator.

Of course also other types of grates and combustion beds than those mentioned may be used.

In the illustrated embodiment the supply of air takes place from below and along the sides of the grate 2, while the quantity of air and the temperature as well as the build-up of pressure in the combustion furnace are continuously adjusted to the combustion process.

To obtain a uniform combustion process and to keep the temperature in the incinerator at the intended level it is important that the controlled air supply and the pressure build-up in the incinerator should not be disturbed.

To this end the charge inlet 3 is provided with sluice means 4 which, in the embodiment shown, consists of two sliding gates defining a charging compartment 5. By opening the upper gate it is possible to let in the intended quantity of combustion material into the charging compartment. After the upper gate has been closed the lower gate can be opened so that the material falls down into the furnace 1.

Also other types of sluice means may of course be used, such as feeding wheels with vane-shaped gates.

The essential point is that the interior of the incinerator should be kept shut off from the environment during the combustion process and also during the charging phases.

In the incinerator the degassing and burning together of the combustion material take place under conditions suggestive of pyrolysis, in which combustible gases are expelled from the combustion material without being burnt out.

Two passages 6 and 7 lead from the incinerator or combustion furnace to a secondary combustion chamber, generally designated by 8.

The secondary combustion chamber 8 is generally cyclindrical and lined with temperature-resistant material.

The passage 6 leading from the top part of the furnace 1 opens tangentially at the upper part of the chamber 8. From the top side of the chamber a ring-shaped screen-off means 9 extends downwardly so far that the mouth of the passage 6 will be situated within the space lying outside said screen-off means.

In the illustrated embodiment the screen-off means 9 is stationary but, alternatively, it may be rotatably mounted.

Provided in the screen-off means 9 is a number of nozzles or the like 10 the function of which will be described below.

The secondary combustion chamber 8 outlet, the first part of which consists of the screen-off means 9, presents beyond said means a widened compartment 11 which passes into the outlet proper 12 leading to a boiler or the like.

The passage 7 from the lower part of the combustion furnace 1 opens at the lower part of the secondary combustion chamber 8 above a conical bottom 13 which, in the embodiment shown, is mounted for rotation.

Provided in the bottom 13 are nozzles 14 the function of which will be described below.

Also provided at the bottom are means for supply of additional heat, e.g. a gas burner 15 and/or an electrical heating device 16 indicated by broken lines. A closable discharge opening is designated by 17.

The function of the secondary combustion chamber is, in broad outline, as follows.

The mainly combustible gases from the incinerator 1 enter through the passage 6 tangentially into the chamber and will thereby move along a helical, downwardly directed path while they are being burnt. During this movement a separation takes place so that heavy components, especially the main part of carried particles, will approach the wall of the chamber while light components gradually decelerate due to their lower weight and approach the centre of the chamber and leave through the central opening of the screen-off means 9.

The heavy particles will sink down gradually along the chamber wall and, if still containing combustible matter, they will be burnt off due to the white-hot walls which contribute to this effect. Remaining non-combustible particles and like components will successively fall down to the chamber bottom where they will take part in the process to be described below.

In another embodiment (not shown), where the screen-off means is rotary, the circulatory motion of the gases can be enhanced and the separation facilitated with the aid of the screen-off means. The rotation of the screen-off means also contributes to preventing deposits on the screen-off means.

The light components, primarily the gaseous ones, but also certain light combustible particles, leaving through the screen-off means 9 and holding a very high temperature, are given a further raise temperature when reaching the space inside the screen-off means 9, because air, oxygen or heat is supplied through the nozzles 10.

As the gases then reach the widened compartment 11 they will move at reduced speed, and the final burnout, initiated by the additional heat, may take place before the gases, completely burnt out and practically free from particles, are allowed to leave through the outlet 12 to a boiler or the like.

When the combustion material is of such nature that the combustion gases will contain certain substances which are hard to handle, it will be possible to add substances neutralizing such hard substances through nozzles in the screen-off means 9.

When it is a matter of combustion material of a more conventional nature the temperature of up to 1700° C.—which is very high as compared to prior art incineration plants—prevailing in the combustion chamber 8 and its outlet, is sufficient to decompose such substances as are normally regarded as difficult to handle in connection with combustion, e.g. sulphur dioxide.

Heavy combustion residues, such as ash, slag, metals and the like, coming from the furnace, enter gradually through the passage 7 and collect on the movable or rotary bottom 13 together with particles falling down along the chamber wall. Owing to the combustion of the gases the temperature in the secondary combustion chamber will be on such a level that ash, slag and the like will be transformed into a melt.

The movable bottom 13 secures continuous stirring of material accumulated on it, so that bridge-formations are prevented and complete melting takes place. It should be noted, however, that also other types of stirring means may be used, for instance a centrally mounted conical body included in a discharge means and inserted in an opening in the combustion chamber bottom.

In order to raise, if required, the temperature adjacent the bottom 13, if the temperature resulting from the combustion of gases is insufficient, there are means 15, 16 for controlling the temperature so that the products will be entirely transformed into a melt.

Air or oxygen, which is supplied through the nozzles 15, results in a decarbonization of the melt, whereby carbon present in the melt, together with added oxygen, forms carbon monoxide which can be burnt and further increases the temperature in the secondary combustion chamber and thus is of use to the process and a following boiler. To a certain degree the added oxygen also oxidizes out metals and the like, contained in the melt.

The remainder of the melt is discharged through the opening 17 and is preferably allowed to pass down into water. When the melt comes into contact with the water, a granulation takes place, and the cooled granulate, which contains no leachable noxious substances, may be freely used for filling purposes and need not be deposited on particular refuse storage areas.

The construction and function described above result in the advantage that energy inherent in the combustion material is maximally utilized because the combustion gases as well as slag and the like are completely burnt out. As a consequence thereof, the residues, both the gaseous and the solid ones, are reduced to a minimum. The very high temperature, prevailing particularly in the secondary combustion chamber and its outlet, contributes—in a manner never realized before—to reducing the discharge of environmental pollutions into the atmosphere. The reduction of acidity in the flue gases results also in the advantage that associated boilers, chimneys and the like will have a substantially longer life than before.

The invention should not be considered limited to that described above and shown in the drawing but may be modified in various ways within the scope of the appended claims.

What I claim and desire to secure by Letters Patent is:

1. A process for combustion of combustion material of heterogeneous nature, using a first chamber for burnout and degassing of the combustion material and a second chamber, communicating with the first chamber, for final combustion and melting of the residual products from the first chamber, characterized by the following steps:—continuously keeping the first chamber (1) closed during operation and also during introduction of combustion material thereinto and supplying to said chamber a controlled amount of combustion air so adjusted that a pyrolitic process will take place therein during which gas is discharged from the combustion material which burns together; transferring incompletely burnt gases expelled from the combustion material, together with gas-borne particles and the like, from the first chamber (1) to the second chamber (8), through a per se known first passage (6) situated in the upper part and opening essentially tangentially into the second chamber, and transferring the burnt-together, partly melted-together remainder of the combustion material from the first to the second chamber, through a second passage (7) situated in the lower part, while the gases which, under the influence of the position of the first passage produce a circulatory motion, in addition to burnout of carried particles and the like, during the combustion in the second chamber cause heating to melting temperature of the material present in the lower part of the chamber (8); and, if required, supplying additional heat to said lower part in order to reach the temperature required for maintaining a melt; and, while the melt is being stirred in the lower part of the chamber, supplying air or oxygen to the melt in order to effect decarbonization of it.

2. A process as claimed in claim 1, wherein temperature-changing gas, air or the like is supplied to the per se known outlet (9) of the second chamber, (8) which projects into said chamber from the top thereof.

3. A process as claimed in claim 1, wherein the combustion in the second chamber (8) by means of the required additional heat is adjusted so as to reach a temperature in the order of 1600°–1700° C. in the melt.

4. Incineration plant including an incinerator or combustion furnace through which combustion material is allowed to pass during successive burnout and degassing and after said incinerator a secondary combustion chamber provided with means for supplying air and intended for the combustion of products having passed the incinerator without being completely burnt out, and in which combustion gases entering the secondary combustion chamber are subjected to a rotary motion facilitating separation of carried particles, and slag having entered said chamber is burnt out, wherein the incinerator or furnace (1), which is provided with a grate (2) adapted to the type of combustion material or combustible concerned and with means for controlled supply of properly tempered combustion air, includes sluice means (4) at the charge inlet (3) to prevent pressure variations in the furnace as well as uncontrolled supply of air, in order to allow pyrolitic, gas-expelling combustion in the furnace, and the secondary combustion chamber (8), in which the gases from the furnace are burnt and at the lower part of which a passage (7) for slag and unburnt residues of combustion material opens, is provided with means for stirring of such material and means (15, 16) securing appropriate slag melting temperature and also has means in said lower part for supplying air or oxygen for decarbonization of said slag melt.

5. Incineration plant as claimed in claim 4, wherein supply means (10) for temperature-increasing gas, air or the like are provided at the secondary combustion chamber outlet which, in a per se known manner, projects into said chamber (8).

6. Incineration plant as claimed in claim 4, wherein the means for causing agitation of material having entered at the lower part of the secondary combustion chamber (8) consists of a rotary bottom part (13).

7. Incineration plant as claimed in claim 4, wherein the means for controlling the temperature in the lower part of the secondary combustion chamber includes at least one burner for gas, oil or the like (15).

8. Incineration plant as claimed in claim 4, wherein the means for controlling the temperature in the lower part of the secondary combustion chamber (8) includes electrical heating means (16).

9. Incineration plant as claimed in claim 4, wherein nozzles are arranged in the bottom part of the secondary combustion chamber (8) to supply air or oxygen to material on said bottom part.

10. Incineration plant as claimed in claim 5, wherein the outlet of the secondary combustion chamber includes a compartment (11) which has a larger area than the remaining part (9, 12) of the outlet and is situated beyond the portion provided with temperature-increasing supply means for gas, air or the like, said compartment reducing the gas flow rate and permitting final burnout and decomposition of the gases.

11. Incineration plant as claimed in claim 5, wherein that portion (9) of the outlet of the secondary combustion chamber which projects into said chamber is rotary.

12. Incineration plant as claimed in claim 4, wherein the secondary combustion chamber (8) is provided with supply means for supplying neutralizing substances.

* * * * *